US005649838A

United States Patent [19]

Sung

[11] Patent Number: 5,649,838

[45] Date of Patent: Jul. 22, 1997

[54] CONNECTOR FOR CONNECTING ELECTRICAL SIGNAL TRANSMITTING CABLE TO A JACK OF AUDIO OR VIDEO EQUIPMENT

[76] Inventor: Allen L. Sung, 5 Concorde Place Suite 3003, Don Mills, Ontario, Canada, M3 C 3M8

[21] Appl. No.: 308,545

[22] Filed: Sep. 21, 1994

[51] Int. Cl.[6] ..... H01R 9/05

[52] U.S. Cl. ..... 439/578; 439/843

[58] Field of Search ..... 439/842, 843, 439/851–856, 607, 578–585, 675, 825, 826

[56] References Cited

U.S. PATENT DOCUMENTS

| | | | |
|---|---|---|---|
| 3,086,190 | 4/1963 | Neidecker et al. | 439/826 |
| 4,453,796 | 6/1984 | Monroe | 439/585 |
| 4,662,706 | 5/1987 | Foley | 439/843 |
| 4,753,616 | 6/1988 | Molitor | 439/843 |
| 4,867,709 | 9/1989 | Molitor et al. | 439/825 |
| 4,932,897 | 6/1990 | Lee . | |

*Primary Examiner*—David L. Pirlot
*Attorney, Agent, or Firm*—Jane Parsons

[57] ABSTRACT

A connector for connecting electrical signal transmitting cable to a corresponding jack of audio or video equipment has a jack engaging socket having spring loaded gripping means for a jack member. The spring loaded gripping means comprise a number of parallel segments bowed inwardly from an inner wall of the socket. These segments are biassed outwardly when the socket is force fitted over a corresponding jack member. There may be a large number of segments. Preferably the segments are angled to the axial direction of the connector.

5 Claims, 3 Drawing Sheets

CONNECTOR FOR CONNECTING ELECTRICAL SIGNAL TRANSMITTING CABLE TO A JACK OF AUDIO OR VIDEO EQUIPMENT

BACKGROUND OF THE INVENTION

1. Field of the Invention

This invention relates to a connector for connecting a balanced electric signal carrier cable to a jack of its associated apparatus. Especially the invention relates to a connector for connecting an audio or video signal transmitting cable to a corresponding jack of audio or video equipment.

2. Acknowledgement of Prior Art

Conventional connectors used for connecting audio and video cables to the associated equipment frequently comprise a cylindrical member for axial connection with the balanced cable at one end. The other end of the cylindrical member has a pin connector coaxially located within a sleeve connector. The pin engages in a socket of the audio or video apparatus and the sleeve connector is forced over an upstanding cylindrical flange of the apparatus to form a second connection. The sleeve connector expands slightly to force fit over the cylindrical flange to make a firm connection. The socket of the apparatus is surrounded by the cylindrical flange of the jack into which the connector plugs.

Problems have been encountered in providing a firm, durable socket connector which does not tend to become less reliable as it ages. Many of the existing socket connectors may distort with age so that they do not fit so closely around the cylindrical flange of the audio apparatus or the material from which they are formed may lose some of its resilience so that the socket connectors do not grip tightly around the flange of the audio apparatus.

Various attempts have been made to mitigate the tendency of the socket connector to loosen or distort with time.

Frequently the socket connector comprises a cylindrical socket having a number of axially directed slots dividing the socket into a number of finger-like projections which provide for the necessary resilience in force-fitting the socket connector over the cylindrical flange of the audio apparatus. The depth of the slots between the fingers and the number of slots influences the ease of expansion of the socket connector and its longevity.

It has been proposed, for example, in the disclosure of U.S. Pat. No. 4,932,897 to Lee et al. and issued Jun. 12, 1990 to locate the slots angularly so that they are parallel one with the other but not with the axis.

All these previous connectors having finger segmented socket connectors for force-fit over an upstanding flange of the corresponding jack of related equipment suffer from loosening of the connector with continual use. The fingers tend to permanently bend outwardly to enlarge the size of the socket. Even the connector of U.S. Pat. No. 4,932,897 may suffer distortion with age.

SUMMARY OF THE INVENTION

The present inventor has addressed the problem of providing a connector for connecting audio or video signal transmitting cable to a jack of related equipment, the connector having a socket connection to force-fit over an upstanding cylindrical flange of the audio or video equipment in which problems of loosening of the socket connection with age and usage may be mitigated.

Accordingly the invention provides a connector for connecting balanced electrical transmitting cable to a jack of apparatus for processing said electrical signal, the connector comprising a housing sleeve to receive said cable at one sleeve end;

a first axial member generally within the sleeve to connect a first conductor of said cable with the jack, the axial member projecting from a front end of the sleeve as a pin for insertion into said jack;

a second axial member generally within the sleeve to connect a second conductor of said cable with the jack, the second axial member projecting from the front end of the sleeve as a thick walled socket for force fit engagement over an upstanding cylindrical connector of said jack, an inner wall surface of socket having parallel segments bowed inwardly therefrom, said thick walled socket acting to restrain said segments against outward distortion.

Preferably, the parallel segments are angled to the longitudinal direction of said double walled socket.

The parallel slots may be closed at each end, the segments being located in a mid-portion of the socket. Thus a distal end of the socket may form an initial entry portion for the upstanding cylindrical connector. This initial entry portion may have smooth walls for easy entry of the cylindrical connector. The number of parallel segments is between 30 and 50, for example about 40.

BRIEF DESCRIPTION OF THE DRAWINGS

An embodiment of the invention will now be described by way of example with reference to the drawings, in which.

DETAILED DESCRIPTION OF A PREFERRED EMBODIMENT

Figure 1:
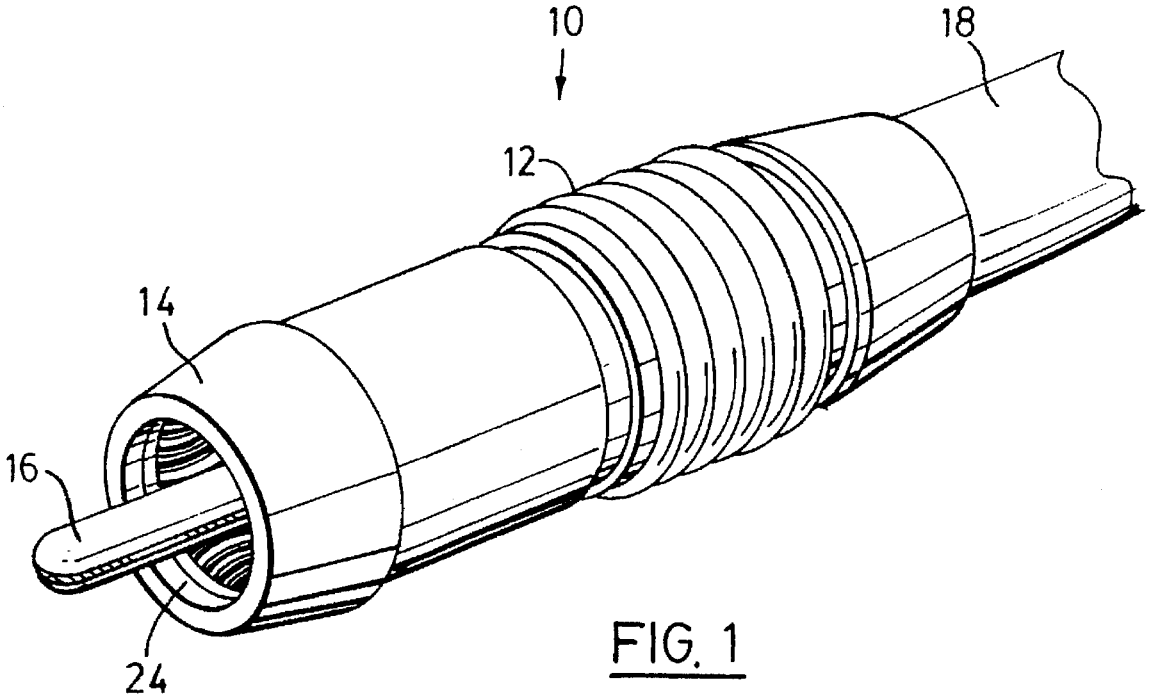
FIG. 1 is a perspective view of a connector according to the invention.
Figure 2:
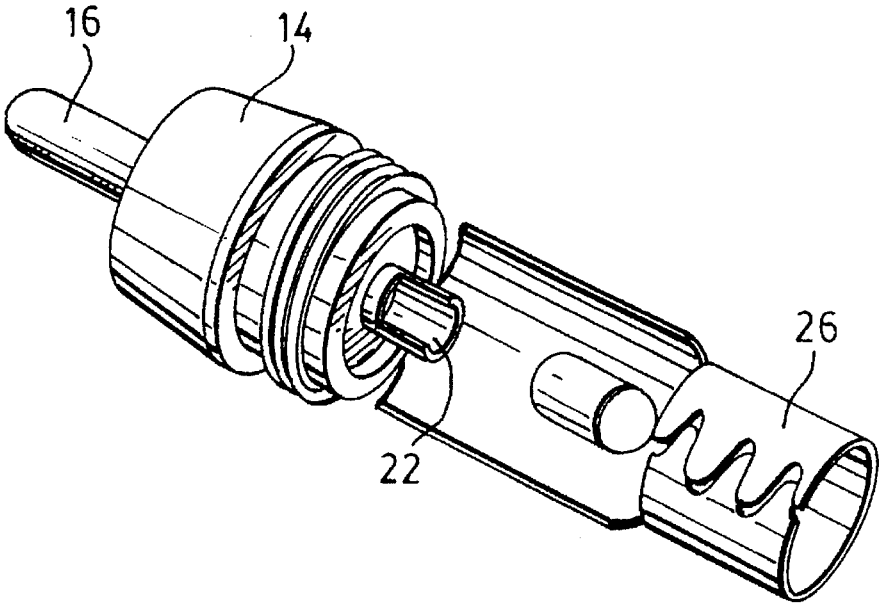
FIG. 2 is a perspective of the connector of FIG. 1 with the outer housing sleeve removed.

A connector 10 comprises a cylindrical housing sleeve 12 from which projects a socket 14 and a pin 16. The pin 16 fits into a socket of a jack of electrical signal processing equipment such as audio or video equipment. The socket 14 forms a force fit connection with an upstanding cylindrical connector of the jack of the equipment.

An electrical signal carrier balanced cable 18 is connected into connector 10 at the end opposed to the socket 14 and the pin 16. The carrier cable 18 may be coaxial cable of which the inner cable is connected to an inner axial terminal 22 of the connector 10 within the housing sleeve 12. The inner terminal 22 is provided at the inner end of pin 16 which projects at its other end out of the socket 14 for connection into the socket of the jack of the audio equipment.

The outer cable of coaxial cable 18 is gripped by a tightenable band 26 within the housing sleeve 12. This tightenable band 26 merges into socket 14 through an intermediate portion 20. Band 26 may be tightened by any convenient means, for example, by crimping or tightening of the band in another manner.

It is to be understood that while inner terminal 22 and tightenable band 26 have been described for use with the coaxial cable 18, other arrangements of connection with the cable are possible.

The socket 14 is a single metal moulding having an inner surface 30 and an outer surface 36 which may be formed unitarily with one another. As illustrated, outer surface 36 is frustroconical and merges into generally cylindrical inner wall 30 through top edge 37. The thickness of the wall of the socket 14 is thus greater as the socket deepens.

Figure 3:
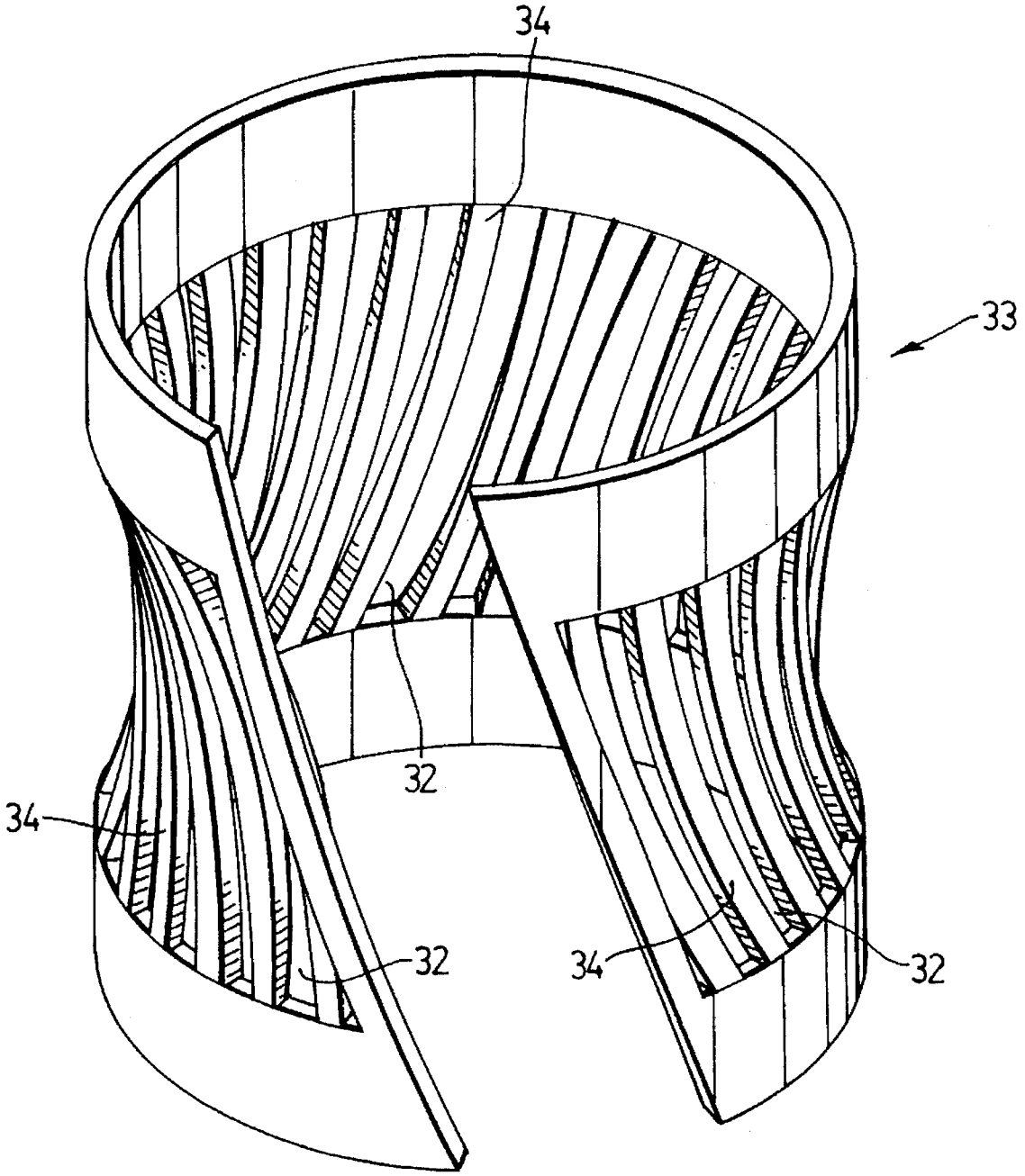
FIG. 3 is a view of a band insert for a connector of FIG. 1.
Figure 4:
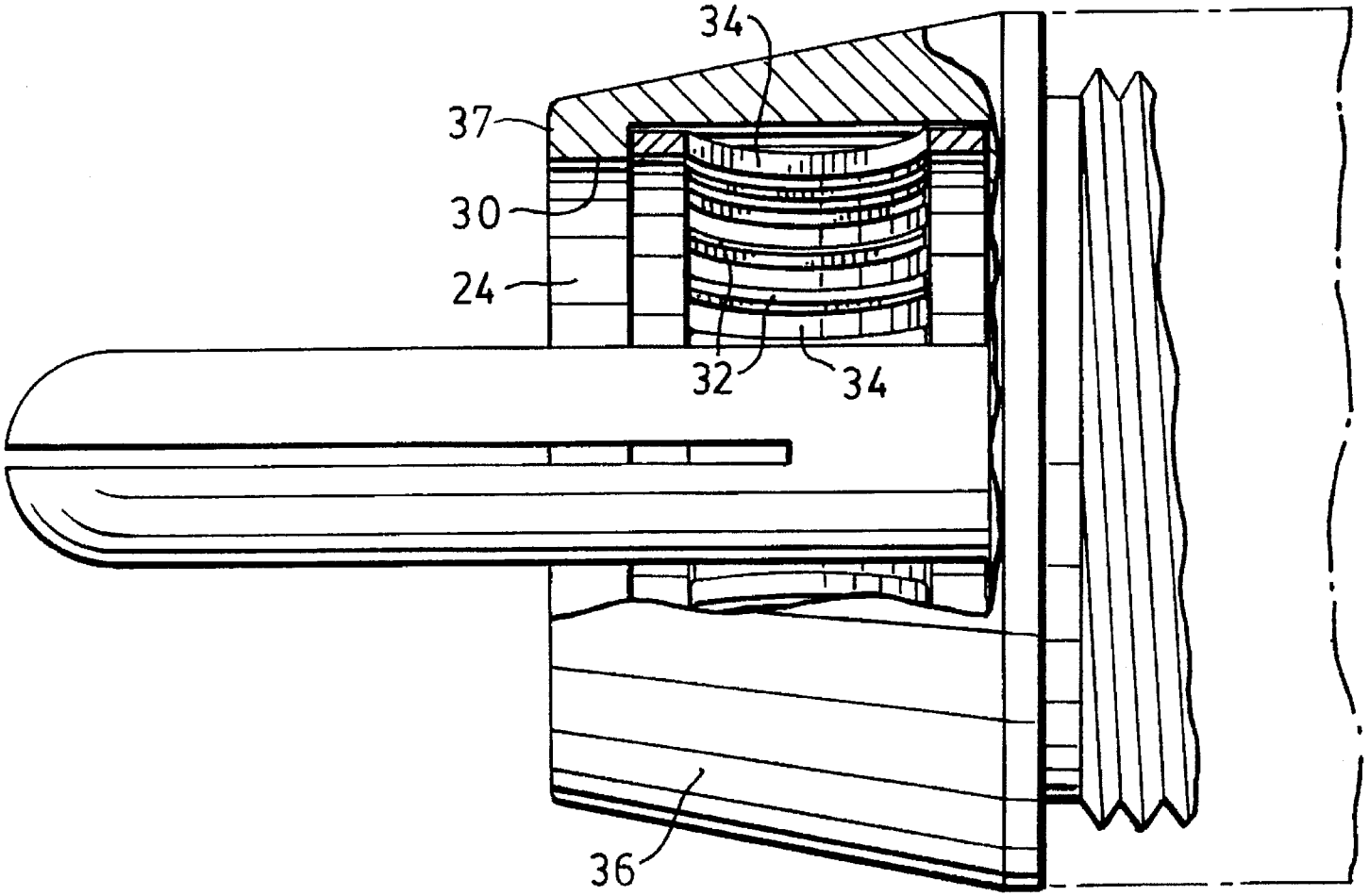
FIG. 4 is an enlarged view of the jack connection end of the connector with the socket connection partially broken away to show its interior.

A slotted band 33 shown in detail in FIG. 3 which is set into inner surface 30 to grip an upstanding connector of the jack of the audio equipment The slotted band 33 has a number of parallel slots 32. Segments 34, between slots 32, are bowed inwardly to effectively reduce the diameter of the socket 14 so that the spring loaded segments form a tight fit to grip the upstanding connector cylinder of the jack. The slots 32 and segments 34 are preferably angled to the direction of the longitudinal axis of the socket 14. While the segments may be aligned with the axis it is preferred that they are angled to it. The angle the segments 34 make with the direction of the axis may be an acute angle, for example, between 10 and 80 degrees or between 20 and 40 degrees. When slots 32 are closed end slots, each end of each segment 34 is integral with margins of band 33 so that there may be little danger of snagging the segments. Although it is possible that slots 32 might be provided at the open end of the double walled socket 14 so that the segments 34 between the slots have the appearance of fingers, the closed end slots 32 illustrated in a mid-section of the sockets may be preferred. When the slots 32 are in the mid-section of the socket, it may be less likely that the free end of a segment be snagged upon entry of the upstanding cylindrical connector of the audio apparatus. As illustrated, the distal end of the socket 14 forms a smooth entry portion 24 for the upstanding connector 11. The entry portion 24 has a diameter such that upstanding connector 11 fits into socket 14 easily.

Socket 34 forms a restraint about band 33 with its bowed segments 34. Because of the presence of slots 32, band 33 is potentially expansible, should the bowed segments 34 be distorted so that they bow outwardly. The restraint offered by outer wall 36 may guard against this possibility. Moreover, the restraint offered by socket wall 36 allows division of the band 33 into a much greater number of segments 34 than would otherwise be possible. It may be of advantage that a large number of segment 34 be present to provide minimum discontinuity of electrical contact over the surface of upstanding connector 11. In conventional connectors where no outer wall is provided, these segments must, themselves, be of appreciable substance and stiffness to guard against distortion tending to loosen the fitting.

In the illustrated embodiment of the present invention of the entry portion 24 of the socket 14 has a smooth inner wall to aid entry. The bowed segments 34 merge smoothly into the entry portion to guard against snagging.

In previous connectors, the numbers of gripping fingers has been limited by the strength of grip required since they have been part of the structure. In the illustrated embodiment of the present invention, the wall 36 of socket 14 may provide strength and restraint and the number of segments 34 of band 33 therefore may be large. It is possible to provide segments greater than say, between 30 and 50 segments 34. The number of slots actually envisaged may be in the region of 40. In the illustration of the invention more care has been given to the pictorial representation of the slots and segments than to their precise number.

While it has been appreciated in the past, that angled segments may give advantages in contact, the provision of a large number of segments set at an angle to the direction of the socket has appeared to present insuperable difficulties due to the potential fragility of such segments. It would have appeared that there would be a high risk of damage to the segments due to the entry of the upstanding connector 11 brushing against the sides of the segments and possibly to bias them or distort them out of position. By the provision of a restraining, outer support wall 36, it may be possible to provide a large number of angled segments with their ends integral with the inner wall without undue risk of damage during the location of the connector into the jack.

I claim:

1. A connector for connecting balanced electrical transmitting cable to a jack of apparatus for processing said electrical signal, the connector comprising:

a housing sleeve to receive said cable at one sleeve end;

a first axial member generally within the sleeve to connect a first conductor of said cable with the jack, the axial member projecting from a front end of the sleeve as a pin for insertion into said jack;

a second axial member generally within the sleeve to connect a second conductor of said cable with the jack, the second axial member projecting from the front end of the sleeve as a thick walled socket for force fit engagement over an upstanding cylindrical connector of said jack, an inner wall surface of socket having parallel segments bowed inwardly therefrom, an electrically conductive slotted band inwardly of and coaxial with an inner wall surface of the socket, the band having segments angled to the longitudinal direction of the thick walled socket, said thick walled socket acting to restrain said segments against outward distortion, the segments being separated one from another by parallel slots which are closed at each end and the segments being located in a mid-portion of the socket.

2. A connector as claimed in claim 1 in which the parallel segments are provided in a band insert for said socket.

3. A connector as claimed in claim 1 in which the parallel segments are angled to the longitudinal direction of an inner surface of the thick walled socket at an angle between 10 and 80 degrees.

4. A connector as claimed in claim 1 in which the number of parallel segments is between 30 and 50.

5. A connector as claimed in claim 4 in which the number of parallel segments is about 40.

* * * * *